US006804932B2

(12) United States Patent
Joyce et al.

(10) Patent No.: US 6,804,932 B2
(45) Date of Patent: Oct. 19, 2004

(54) ENVELOPE SEALING DEVICE FOR A MAILING MACHINE

(75) Inventors: Steven H. Joyce, Wallingford, CT (US); Donald Surprise, Waterbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/382,399

(22) Filed: Mar. 6, 2003

(65) Prior Publication Data

US 2004/0172922 A1 Sep. 9, 2004

(51) Int. Cl.[7] ..... B65B 7/20

(52) U.S. Cl. ..... 53/377.6; 53/378.3; 53/569; 53/284.3; 100/171; 156/441.5; 156/442.2; 156/582; 271/2

(58) Field of Search ..... 53/460, 569, 206, 53/284.3, 376.2, 378.3, 377.6, 476; 156/441.5, 442.2, 582; 271/2; 100/171, 154

(56) References Cited

U.S. PATENT DOCUMENTS 426,728 A * 4/1890 Maret ..... 156/441.5
3,072,397 A * 1/1963 Kelchner ..... 271/245
4,461,212 A * 7/1984 Geney ..... 101/407.1
4,605,218 A * 8/1986 Knepper et al. ..... 271/238
4,705,413 A * 11/1987 Arnoldi et al. ..... 400/56
4,763,575 A 8/1988 Miciukiewicz
4,938,129 A 7/1990 Miciukiewicz et al.
5,674,348 A * 10/1997 DeFiguerido ..... 156/441.5
5,809,752 A * 9/1998 Holbrook ..... 53/569
6,041,569 A 3/2000 Freeman et al.
6,062,003 A * 5/2000 Freeman et al. ..... 53/569
6,554,956 B1 * 4/2003 Dolan et al. ..... 156/441.5
6,701,693 B2 * 3/2004 Benard et al. ..... 53/569

* cited by examiner

*Primary Examiner*—Stephen F. Gerrity
(74) *Attorney, Agent, or Firm*—Brian A. Lemm; Angelo N. Chaclas

(57) ABSTRACT

The present invention includes apparatus and methods for sealing an envelope. A sealing nip is formed by an upper roller and a lower roller. The upper roller is mounted on an upper shaft and the lower roller is mounted on a lower shaft. A mechanism associated with the lower shaft adjusts the orientation of the lower shaft to match the orientation of the upper shaft.

20 Claims, 6 Drawing Sheets

ENVELOPE SEALING DEVICE FOR A MAILING MACHINE

FIELD OF THE INVENTION

This invention relates generally to the field of mailing machines, and more particularly to sealing an envelope that is being fed through a mailing machine.

BACKGROUND OF THE INVENTION

Generally, an envelope transport on a mailing machine transports envelopes along a feed path so that various functions may be performed on the envelope at different locations along the feed path. For example, at one location along the feed path the envelope may be weighed, at another location the envelope may be sealed, and at a further location an indicium for postage may be applied to the envelope. Drive rollers and/or drive belts may be employed to contact the envelope to propel the envelope along the feed path.

An envelope sealing component that is conventionally included in a mailing machine includes a sealing nip formed by an upper sealer roller and a lower sealer roller. After the adhesive on the envelope flap is moistened, the envelope is transported so that the portion of the envelope that includes the flap is fed through the sealing nip. As the portion of the envelope that includes the flap is fed through the sealing nip, the upper sealer roller applies pressure to the face of the envelope, and the lower sealer roller applies pressure to the back of the envelope, including the flap, so that the envelope is sealed.

Each of the sealer rollers is mounted on a respective shaft. When the mailing machine and its envelope sealing component are constructed in an ideal manner, the two shafts are exactly parallel in their respective orientations, so that the two sealer rollers apply substantial pressure to the envelope throughout the locus of the gummed portion of envelope flap. However, design tolerances and/or errors in assembly of the mailing machine may result in the two shafts being misaligned such that the shafts are at an angle to each other. In that case, most or all of the pressure applied to the envelope by the sealing nip may be concentrated at a small portion of the length of the sealer rollers. As a result, some or all of the gummed portion of the envelope flap may not be firmly pressed against the back of the envelope, so that the envelope is not reliably sealed by the sealing nip.

Therefore, it would be advantageous to provide apparatus and methods that improve the reliability of an envelope sealing component of a mailing machine.

SUMMARY OF THE INVENTION

Accordingly, an improved apparatus and method for sealing an envelope is provided. The improved apparatus includes an upper roller and a lower roller positioned relative to the upper roller such that the upper and lower rollers form an envelope sealing nip. The improved apparatus further includes an upper shaft on which the upper roller is mounted and a lower shaft on which the lower roller is mounted. The improved apparatus also includes a mechanism associated with the lower shaft for adjusting an orientation of the lower shaft to match an orientation of the upper shaft.

For example, the adjusting mechanism may include a ski which has a pair of ski arms for mounting the lower shaft. Each of the arms may have a slot formed therein, with a respective end of the lower shaft received in each of the slots. The adjusting mechanism may further include a pair of biasing mechanisms, such as torsion springs, for upwardly biasing the respective ends of the lower shaft in an upward direction.

In another aspect, a device for processing envelopes includes a base and a feed mechanism mounted on the base for feeding envelopes along a feed path adjacent a registration wall. The feed mechanism includes an endless belt having a lower belt run that is adapted to contact and propel the envelopes along the feed path. The feed mechanism further includes a plurality of pressure rollers biased to contact a lower surface of the lower belt run. The feed mechanism also includes a plurality of backup rollers in contact with an upper surface of the lower belt run. The device for processing envelopes further includes an upper sealer roller mounted on a common shaft with one of the backup rollers for rotation with the one of the backup rollers. The device for processing envelopes also includes a support shaft that extends substantially horizontally from the registration wall toward the feed mechanism. Also included in the device for processing envelopes is a ski that is pivotally mounted on the support shaft. The ski has two arms extending upwardly substantially in parallel to each other. Each of the arms has a respective slot formed therein. Each of the slots has a generally vertical course. The device for processing envelopes further includes an idler shaft having a first end received in one of the slots and a second end received in the other one of the slots. The device for processing envelopes also includes a lower sealer roller mounted on the idler shaft and in contact with the upper sealer roller. Also included in the device for processing envelopes is a first torsion spring installed on the support shaft adjacent one of the arms and in contact with the first end of the idler shaft to bias the first end of the idler shaft in an upward direction. The device for processing envelopes further includes a second torsion spring installed on the support shaft adjacent the other one of the arms and in contact with the second end of the idler shaft to bias the second end of the idler shaft in an upward direction.

The courses of the slots may be substantially straight or curved.

In still another aspect, a method is provided for sealing an envelope. The method includes forming a nip constituted by an upper roller mounted on an upper shaft and a lower roller mounted on a lower shaft. The method further includes allowing an orientation of the lower shaft to be adjusted according to at least one of (a) an orientation of the upper shaft, and (b) a cross-sectional profile of an envelope fed through the nip. The method also includes transporting the envelope through the nip.

The allowing step may include allowing an end of the lower shaft to travel in a slot in which the end is received. The end of the lower shaft may be biased in an upward direction.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes apparatus and methods for sealing an envelope. The apparatus includes a sealing nip in which a lower roller is mounted on a "floating" shaft. The lower roller shaft is held at either end in slots that allow the ends to move vertically. Each end is independently biased upwardly. The orientation of the lower roller shaft adjusts automatically to match an orientation of the shaft for an upper roller of the nip, or to accommodate an uneven cross-sectional profile of an envelope fed through the sealing nip. Consequently, substantial pressure can reliably be applied to the envelope flap along the length of the sealing rollers.

Figure 1:
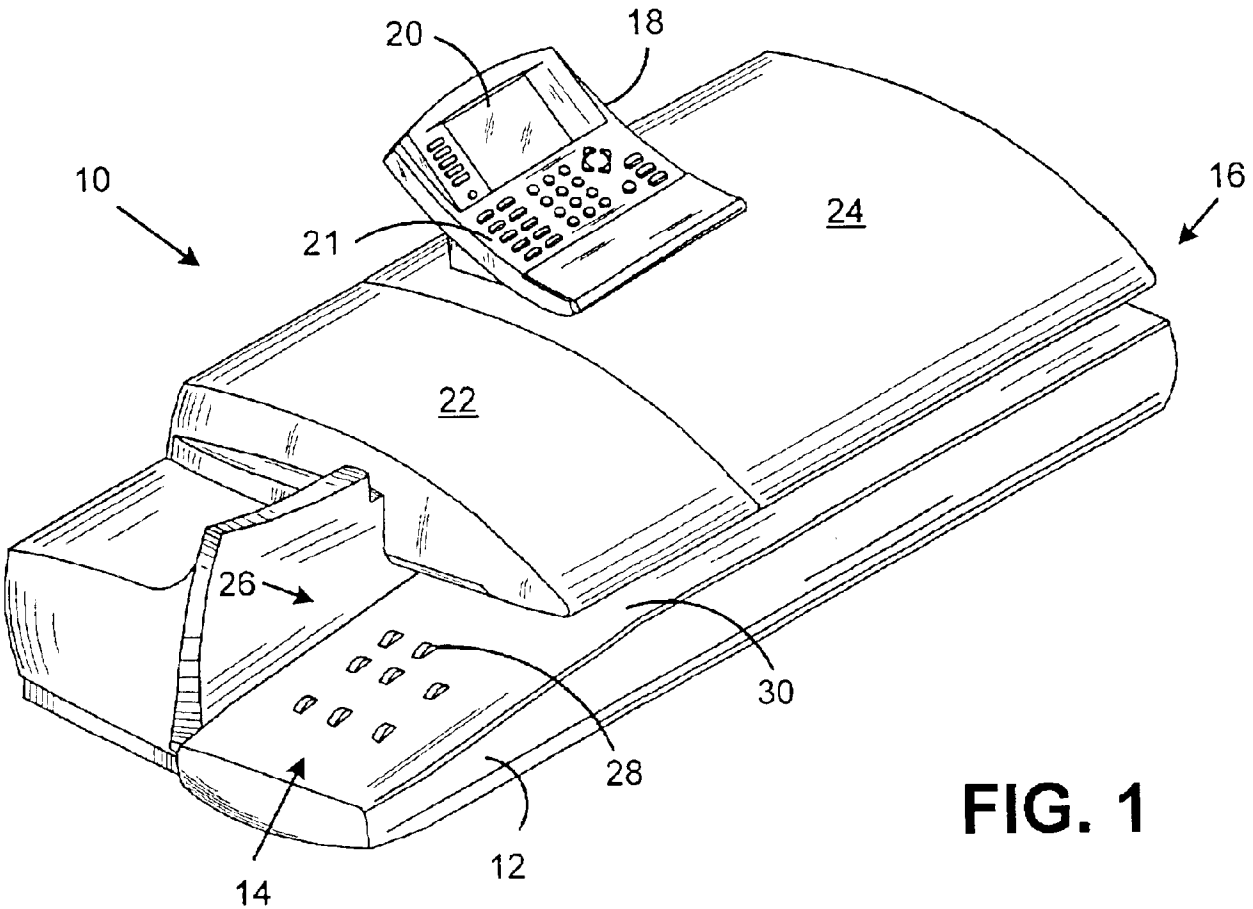
FIG. 1 is a perspective view of a typical mailing machine constructed and arranged in accordance with the principles of the present invention.

Referring now to the drawings, and particularly to FIG. 1, the reference numeral 10 indicates generally a typical mailing machine that incorporates the principles of the present invention. The mailing machine 10 includes a base unit generally designated by the reference numeral 12. The base unit 12 has an envelope infeed end, generally designated by the reference numeral 14 and an envelope outfeed end, designated generally by the reference numeral 16.

Cover members 22, 24 are pivotally mounted on the base 12 and are moveable between a closed position shown in FIG. 1 and an open position (not shown). A control unit 18, having one or more input/output devices, such as, for example, display 20 and keyboard 21, is suitably mounted on the cover 24 so as to be conveniently accessible to an operator. In the open position of the cover members 22, 24 various operating components and parts are exposed for service and/or repair as needed. An envelope transport mechanism which will be described in more detail below is housed under the cover member 24. An envelope sealing mechanism provided in accordance with principles of the present invention is associated with the envelope transport mechanism and will be described below.

An envelope stacking location 26 at the infeed end 14 of the base 12 may hold a stack of envelopes. Nudger rollers 28 are provided to convey single envelopes across a deck 30 toward the envelope transport mechanisms which are under the cover members 22, 24. The envelopes may be singulated and the flaps thereof moistened on the way to, or while being transported by, the envelope transport mechanism under cover member 22. The singulating and moistening operations may be performed by mechanisms which are not visible in the drawing. These mechanisms may be provided in accordance with conventional practices.

Figure 2:
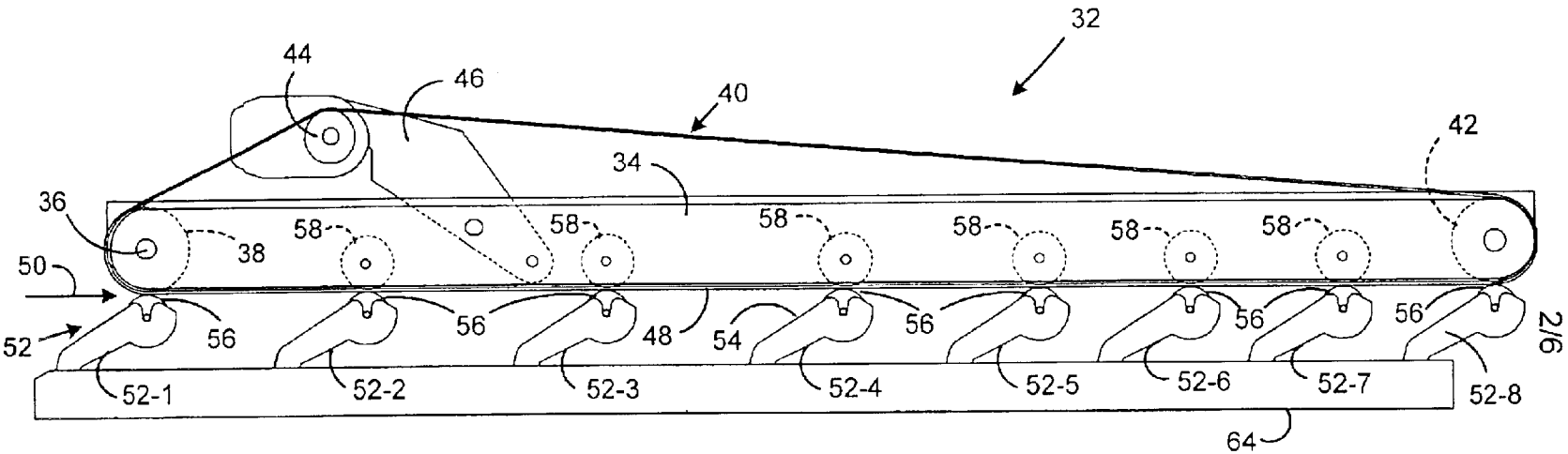
FIG. 2 is a front elevation of a portion of the mailing machine shown in FIG. 1.

FIG. 2 is a partial front elevational view of the envelope transport mechanism (generally designated by reference numeral 32) that is hidden under the cover member 24 shown in FIG. 1. Continuing to refer to FIG. 2, the envelope transport mechanism 32 includes an elongate frame 34 which is pivotally mounted on a shaft 36. The shaft 36 is mounted in a conventional manner to the base unit 12 (FIG. 1, not shown in FIG. 2). A drive roller 38 is fixedly mounted on the shaft 36 for rotation therewith. An endless belt 40 extends around the drive roller 38 and an idler roller 42 mounted adjacent the other end of the frame 34. The belt 40 also passes over a tensioning roller 44 mounted on the free end of a spring-loaded arm 46 which is suitably mounted on the frame 34 so as to maintain proper operating tension on the belt 40. The belt 40 includes a lower belt run 48 which extends in a generally horizontal orientation and feeds envelopes along a feed path (generally indicated by an arrow 50) defined by the envelope transport mechanism 32.

A plurality of pressure roller assemblies, designated generally by the reference numeral 52, are suitably mounted on the base 12, each roller assembly 52 having a spring-loaded arm 54 pivotally mounted on the base 12. Each arm 54 carries a pressure roller 56 adjacent a free end of the arm 54. The plurality of rollers 56 are provided to maintain an envelope in firm driving engagement with the under surface of the lower belt run 48. To prevent the belt 40 from deflecting due to the force imparted by the arms 54, a backup roller 58 is provided behind the belt 40 at each point where the belt 40 is in contact with a pressure roller 56.

An envelope sealing mechanism (not visible in FIG. 2) provided in accordance with the invention is associated with the envelope transport mechanism 32 and is positioned to the rear of the envelope transport mechanism, such as, for example, behind roller assembly 52-4.

Figure 3:
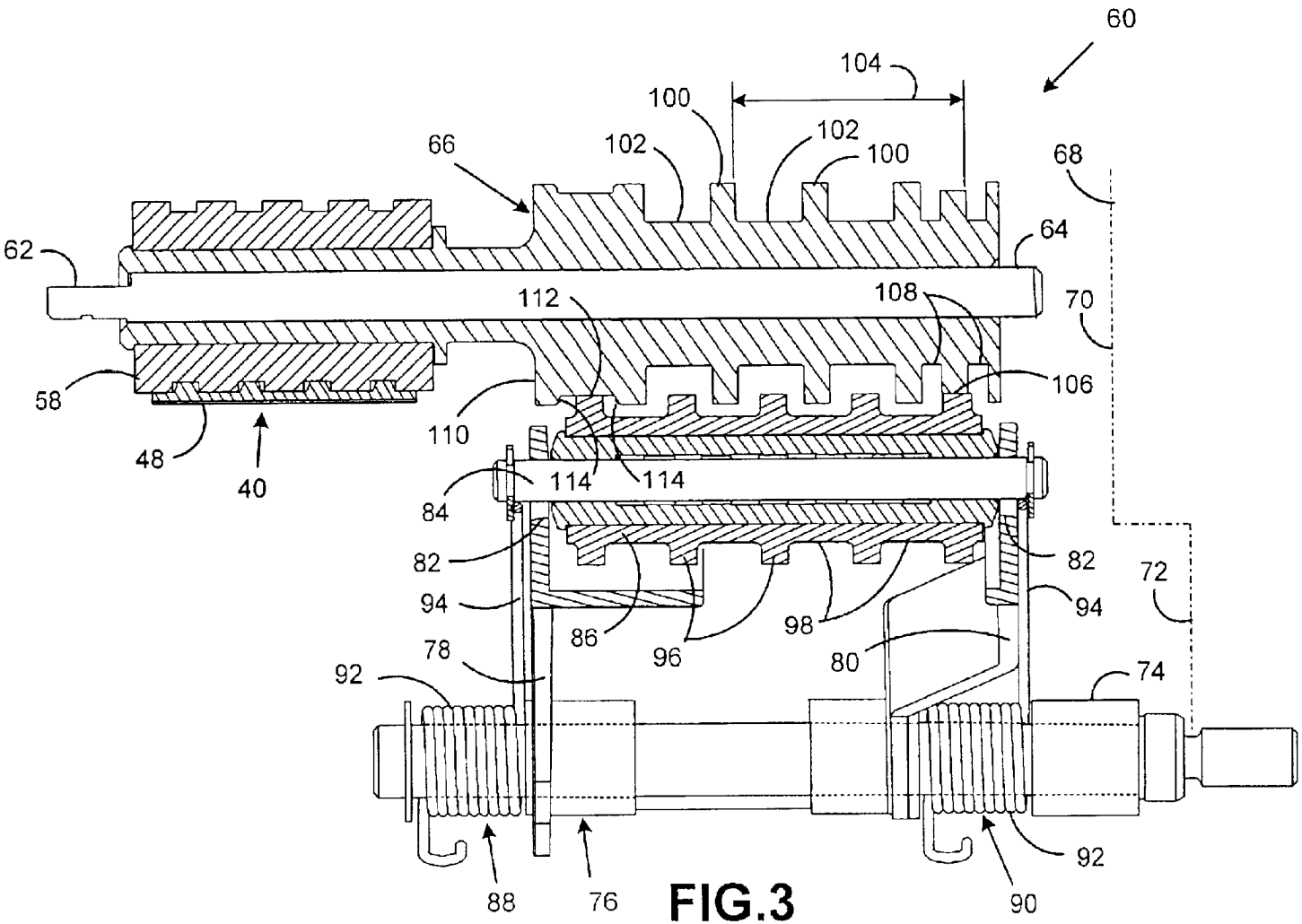
FIG. 3 is a cross-sectional view of an envelope sealing mechanism constructed and arranged in accordance with the principles of the present invention and included in the mailing machine of FIG. 1.

FIG. 3 is a cross-sectional view of the envelope sealing mechanism, which is generally indicated by the reference numeral 60. The envelope feed belt 40 and one of the backup rollers 58 of the envelope transport mechanism are shown in section in FIG. 3. For example, backup roller 58 may be associated with the pressure roller 56 of roller assembly 52-4. The backup roller 58 shown in FIG. 3 is mounted on a shaft 62. The shaft 62 includes an extension 64 that extends to the rear of the envelope transport mechanism. Mounted on the shaft extension 64 for rotation therewith is an upper sealer roller 66.

A registration wall 68 (shown in phantom) is located to the rear of the shaft extension 64 and extends parallel to the feed path for the envelopes. In accordance with conventional practices, envelopes are fed along the feed path with top edges of the envelopes abutting the registration wall. The registration wall 68 includes an upper registration portion 70 and a lower recessed portion 72.

Figure 4:
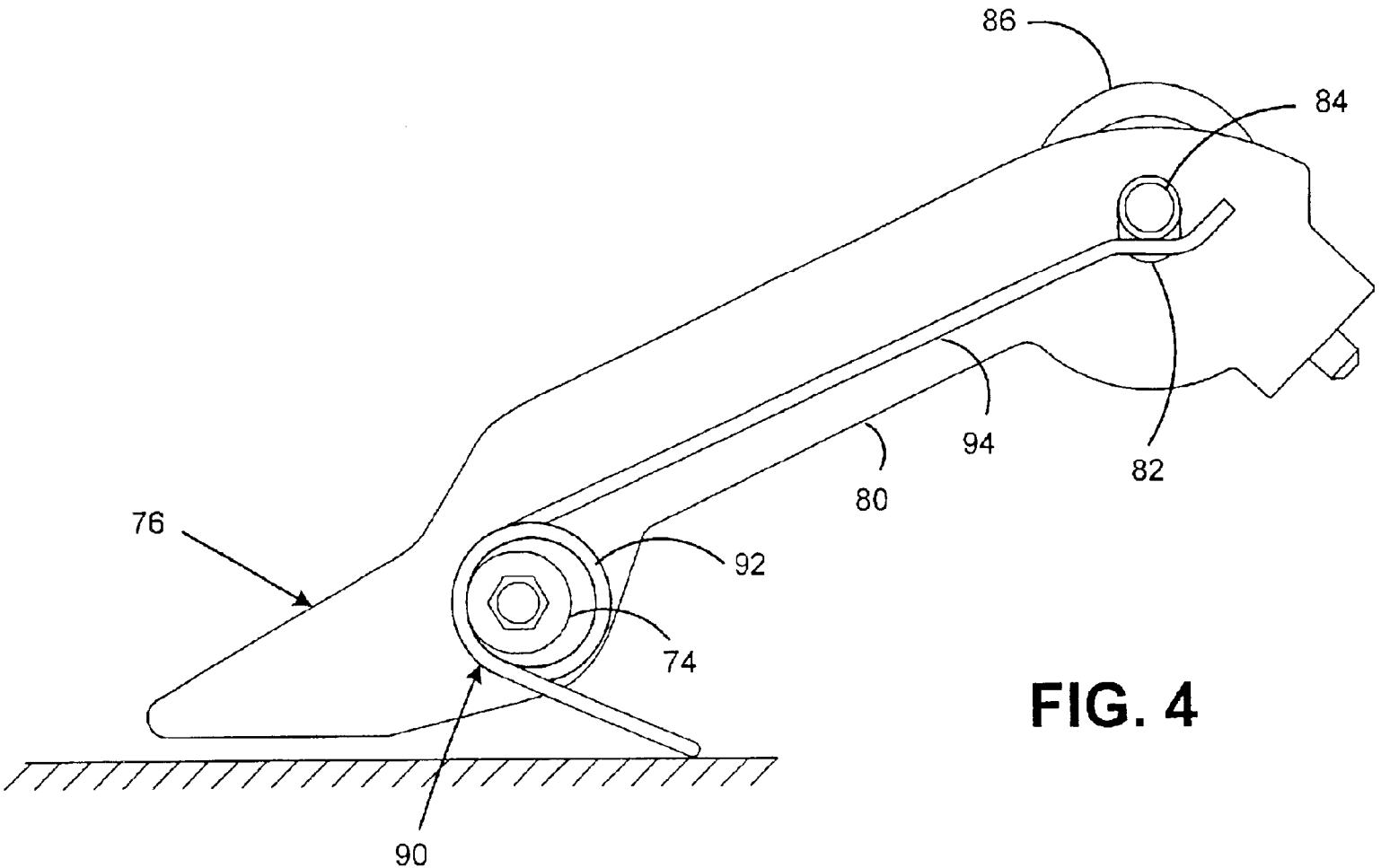
FIG. 4 is a side elevation of a portion of the sealing mechanism of FIG. 3.

A support shaft 74 extends out from the lower recessed portion 72 of the registration wall 68 toward the envelope transport mechanism. A pivoting ski 76 is pivotally mounted on the support shaft 74 (as can also be seen from FIG. 4, which includes a side view of the ski 76). The ski 76 includes left and right ski arms 78, 80 which extend upwardly and generally parallel to each other. A respective slot 82 is formed at an upper end of each of the arms 78, 80. As best seen in FIG. 4, each slot 82 may have a substantially straight, vertical course. A lower roller shaft (also referred to as an idler shaft) 84 is held between the arms 78, 80 with respective ends of the shaft 84 received in each one of the slots 82. A lower sealer roller 86 is mounted on the shaft 84. A first torsion spring 88 is installed on an outer end of the support shaft 74 adjacent the left arm 78 of the ski 76. A second torsion spring 90 is installed on the support shaft 74 between the ski 76 and the registration wall 68 and adjacent the right arm 80 of the ski. In accordance with conventional practices each torsion spring has a cylindrical body 92. It will be noted that the support shaft 74 is received in the bodies 92 of the torsion springs 88, 90. Each torsion spring also has an upper leg 94 which has an outer tip in contact with a respective end of the shaft 84 to bias the shaft end in an upward direction. It will be noted that each end of the shaft 84 is independently biased upwardly by a respective one of the springs 88, 90.

It will also be observed from FIG. 3 that the lower sealer roller 86 has an outer diameter that varies along a longitudinal axis of the roller 86 so that radial rings 96 and radial grooves 98 are formed on the roller 86. Similarly, the upper sealer roller 66 has an outer diameter that varies along a longitudinal axis of the roller 66 so that radial rings 100 and radial grooves 102 are formed on the roller 66. Some of the rings 96 of the lower sealer roller 86 are staggered relative to the rings 100 of the upper sealer roller so that some (but not all) of the radial rings 96 of the lower sealer roller 86 coincide in an axial direction with radial grooves 102 of the upper sealer roller 66. With this arrangement, the rollers 66, 86 are in contact with each other only at their ends, and not at a central portion. The purpose of this arrangement is to prevent transfer of fluid from the lower sealer roller 86 to the upper sealer roller 66 in a printing zone (indicated at 104) which corresponds to a region on the face of the envelope at which a postage indicium may be printed. The fluid may be transferred to the lower sealer roller 86 from envelope flaps that have been moistened prior to sealing. If the fluid were to be further transferred to the upper sealer roller 66 in the printing zone 104, the fluid could then be transferred from the upper sealer roller 66 to the face of the envelope in such a way as to possibly interfere with proper printing of the postage indicium on the face of the envelope. For the same reason, a point of contact 106 between the upper sealer roller 66 and the lower sealer roller 86 at an outer end of the upper sealer roller 66 is isolated by grooves 108 on the upper sealer roller 66 to inhibit transfer of fluid to the upper sealer roller 66 from the lower sealer roller 86.

In addition, the upper sealer roller 66 includes a stop region 110 at its inner end to capture a ring 112 on the lower sealer roller 86 to limit the movement of the lower sealer roller in an axial direction to prevent other rings 96 on the lower sealer roller 86 from contacting rings 100 of the upper sealer roller 66. Again the purpose is to inhibit transfer of fluid from the lower sealer roller 86 to the upper sealer roller 66 in the printing zone 104. Chamfers 114 may be provided in the stop region 110 to aid in guiding the ring 112 to the center of the stop region after an envelope has passed between the upper and lower sealer rollers.

The upper sealer roller may have a maximum radius (at rings 100) and the lower sealer roller may have a maximum radius (at rings 96) such that the sum of the two maximum radii is greater than the center-to-center distance between the two rollers. Consequently, the rings 96 of the lower sealer roller may enter a short distance into the grooves 102 of the upper sealer roller, and the rings 100 of the upper sealer roller may enter a short distance into the grooves 98 of the lower sealer roller. For relatively thin envelopes, the slightly intruding rings 96, 100 may produce a mild corrugation effect on the envelope in the region of the flap, which may aid in applying sufficient pressure on the envelope flap to provide reliable sealing.

The maximum radius of the upper sealer roller is preferably chosen so that the outer surfaces of the rings 100 are the same distance from the central axis of the shaft 64 as the lower surface of the belt 40. This may aid in matching the velocity of the ring outer surfaces to the belt velocity to help prevent skewing of the envelope as it encounters the sealing nip formed by the upper and lower sealer rollers.

The upper sealer roller may be just over 2 inches long, with a maximum diameter of about 0.965 inch. The lower sealer roller may be of similar length with a maximum diameter of 0.740 inch. Alternatively, the lower sealer roller need not be smaller in maximum diameter than the upper sealer roller, but rather could be equal to or larger than the upper sealer roller in maximum diameter. It is preferred that the outer diameters of the two rollers at their grooves be made as small as feasible to minimize the chance of throwing fluid from the grooves to the other roller.

Figure 5:
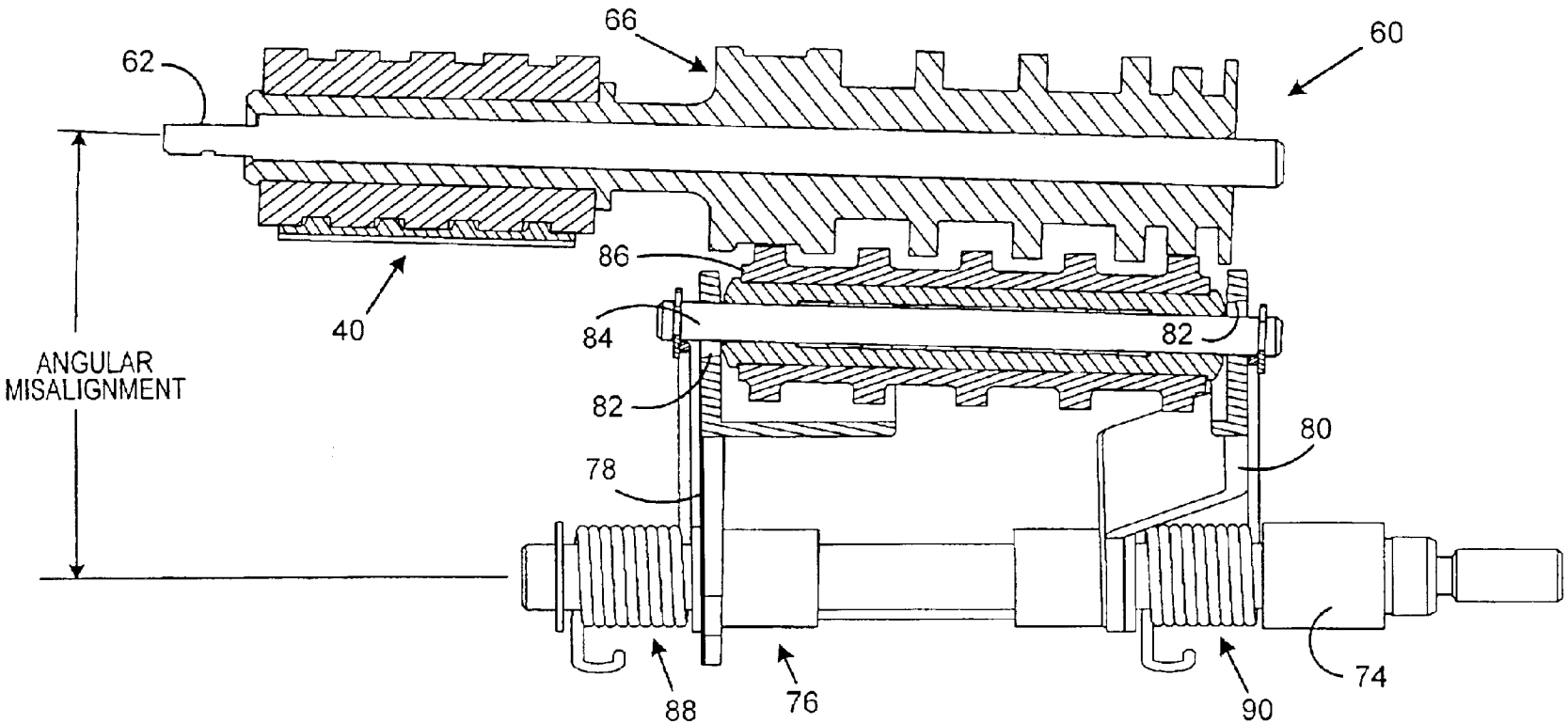
FIG. 5 is a view similar to FIG. 3, showing how, in accordance with the principles of the present invention, the sealing mechanism adjusts for misalignment.

The configuration of the sealing mechanism 60 depicted in FIG. 3 is an ideal one in the sense that the support shaft 74 and the common shaft 62 of the rollers 58, 66 are parallel to each other. However, it is a feature of the present invention that the lower sealer roller 86 is mounted in such a way as to adjust for angular misalignment of the shafts 62, 74. Such a misalignment could occur due to one or more of stack-up tolerances, improper assembly of the mailing machine, and uneven loading. An example of such a misalignment is depicted in FIG. 5. In particular, in FIG. 5 the shaft 62 on which the upper sealer roller 66 is mounted is shown to be inclined downwardly as it extends away from the envelope transport mechanism. The support shaft 74 is presented as ideally horizontal in the example illustrated in FIG. 5. Thus the shafts 62, 74 are misaligned. Nevertheless, the mounting structure for the lower sealer roller 86 compensates for the misalignment of the shafts 62, 74. Specifically because the lower roller shaft 84 has its ends mounted in slots 82 formed in the ski arms 78, 80, and each end of the shaft 84 is independently biased upwardly, the orientation of the shaft 84 is automatically adjusted to match the orientation of the shaft 62. That is, the position of each end of the shaft 84 is determined by the contact of the lower sealer roller 86 at that end with the upper sealer roller 66, which limits movement in the upward direction of the upwardly biased end of the shaft 84. In the particular example shown in FIG. 5, the end of the shaft 84 which is received in the slot 82 of the left ski arm 78 is in the upper part of the course of that slot, while the end of the shaft 84 which is received in the slot 82 of the right ski arm 80 is in the lower part of the course of that slot, so that the shaft 84 inclines downwardly away from the envelope transport mechanism, matching the inclination of the shaft 62. The shafts 62, 84 are therefore substantially parallel, and the rollers 66, 86 are substantially in contact with each other at both ends, so that the rollers apply substantial pressure to an envelope which passes through the nip formed by the rollers all along the length of the rollers. This helps to assure that proper sealing pressure is applied across the entire envelope flap, notwithstanding the misalignment of the shafts 62, 74.

It will be appreciated that the mounting arrangement for the shaft 84 also could compensate for misalignment due to the shaft 62 being upwardly inclined and/or due to deviation of the shaft 74 from the horizontal.

Another advantage of the mounting arrangement for the lower sealer roller is that it can adjust the sealing nip to envelopes having a cross-sectional profile that is not flat.

Figure 6:
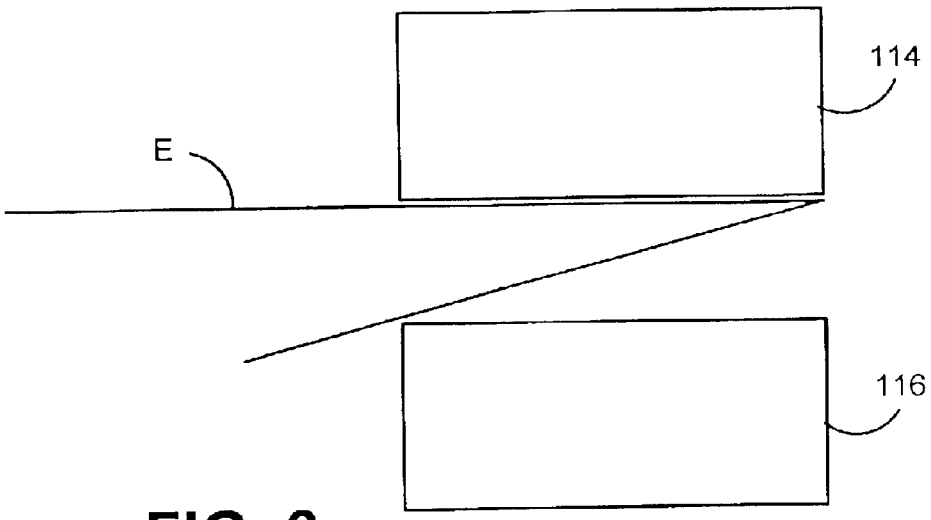
FIG. 6 ( PRIOR ART )
FIG. 6 is a schematic illustration of a problem that may be encountered when a conventional envelope sealing mechanism attempts to seal an envelope that has a wedge-shaped cross-sectional profile.

FIG. 6 schematically illustrates how an envelope having a non-flat cross-sectional profile can present a problem for a conventional sealing nip. In FIG. 6, reference numeral 114 designates an upper sealer roller, reference numeral 116 designates a lower sealer roller, and reference character E designates an envelope having a wedge-shaped cross-sectional profile. It is assumed that the sealing nip illustrated in FIG. 6 lacks the lower roller articulation feature illustrated in FIGS. 3–5 and that the rollers 114 and 116 are mounted so as to be constrained to remain parallel to each other. As a result, the uneven shape of the envelope E forces one end of the lower roller 116 out of contact with the envelope E. Consequently, the conventional sealing nip illustrated in FIG. 6 applies pressure to the envelope only at one end of the rollers 114, 116 and therefore fails to provide sealing pressure to the envelope all along the rollers. It is likely that unsatisfactory sealing of the envelope flap will occur in the situation shown in FIG. 6.

Figure 7:
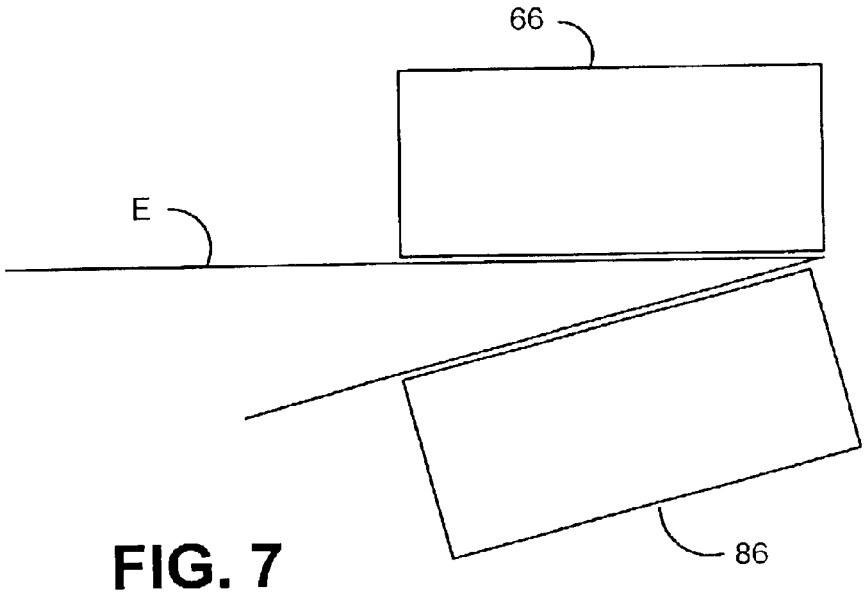
FIG. 7 is a schematic illustration similar to FIG. 6, but showing how the sealing mechanism of FIG. 3 may handle an envelope that has a wedge-shaped cross-sectional profile.

By contrast, FIG. 7 schematically illustrates how the sealing nip shown in FIGS. 3 and 5 would handle the wedge-shaped envelope E. Because of the presence of the slots 82, the lower roller shaft 84 need not remain parallel to the shaft 62 at all times. Thus the sealing nip may adapt to the cross-sectional profile of an envelope passing therethrough, as illustrated in FIG. 7, with one end of the lower roller 86 being downwardly displaced to adjust to the envelope E. In this case the sealing nip applies substantial pressure to the envelope all along the length of the rollers 66, 86, so that proper sealing of the envelope flap is likely.

Figure 8:
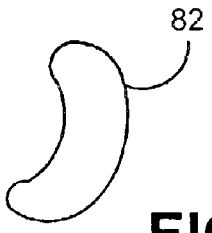
FIG. 8 illustrates an inner profile of a slot that may be provided in an alternative embodiment of the envelope sealing mechanism of FIG. 3.

It is preferred that the slots 82 be straight slots (i.e., have a straight course) as seen from FIG. 4, in order to substantially fix the point of common tangency of the rollers 66, 86. However, as an alternative the slots 82 could have a curved course (i.e., could be curved slots) in accordance with the example illustrated in FIG. 8.

In operation of the mailing machine 10, an envelope E is transported from the envelope stacking location 26 (FIG. 1) toward the envelope transport mechanism 32 (FIG. 2). On the way to the envelope transport mechanism, or near an upstream end of the envelope transport mechanism, the envelope flap may be moistened in a conventional manner.

The envelope transport mechanism then feeds the envelope along the feed path 50 so that the portion of the envelope which includes its flap passes through the sealing nip formed by the sealer rollers 66, 86. The driver roller 38 is driven by a mechanism (which is not shown) to impart motion to the belt 40. The belt 40 applies a feeding force to the envelope. The upper surface of the lower run 48 of the belt 40 is pressed against the backup rollers 58 by action of the spring-loaded arms 54. Consequently, the belt 40 causes the backup rollers 58, including the roller 58 shown in FIG. 3, to rotate. The shaft 62 accordingly rotates with the roller 58, causing the upper sealer roller 66 to rotate. The upper sealer roller 66, in turn, drives the lower sealer roller 86. Because of the mounting mechanism provided for the lower sealer roller 86, the sealing nip reliably applies pressure to the envelope along the entire length of the rollers 66, 86, notwithstanding possible misalignment of the shafts 62, 74 or possible unevenness in the cross-sectional profile of the envelope. Thus the sealing nip illustrated in FIG. 3 operates reliably to perform proper sealing of the envelope flap.

Downstream from the sealing nip, one or more additional processes may be applied to the envelope, such as printing a postage indicium on the envelope at a printing station which is not shown. The envelope is then outfed from the mailing machine 10 at its outfeed end 16.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. For example, the upper and lower sealer rollers need not have rings and grooves as shown in FIGS. 3 and 5 or could have rings and grooves in other configurations than as shown. Other variations relating to implementation of the functions described herein can also be implemented. Accordingly, other embodiments are within the scope of the following claims.

What is claimed is:

1. An envelope sealing device comprising:

an upper roller;

a lower roller positioned relative to the upper roller such that the upper and lower rollers form an envelope sealing nip;

an upper shaft on which the upper roller is mounted;

a lower shaft on which the lower roller is mounted; and means associated with the lower shaft for adjusting an orientation of the lower shaft to match an orientation of the upper shaft, the means for adjusting including a ski having a pair of ski arms for mounting the lower shaft.

2. The device according to claim 1, wherein each of the ski arms has a slot therein, each of the slots having a respective end of the lower shaft received therein.

3. The device according to claim 2, wherein the slots are straight slots.

4. The device according to claim 2, wherein the slots are curved slots.

5. The device according to claim 2, wherein the means for adjusting includes a pair of biasing means, each of the biasing means for biasing a respective end of the lower shaft in an upward direction.

6. The device according to claim 5, wherein each of the biasing means includes a respective torsion spring.

7. The device according to claim 6, further comprising a support shaft on which the ski is pivotally mounted.

8. The device according to claim 7, wherein each of the torsion springs includes a cylindrical body within which the support shaft is received.

9. An envelope sealing device comprising:

an upper roller having an outer diameter that varies along a longitudinal axis of the upper roller to form radial rings and radial grooves;

an upper shaft on which the upper roller is mounted;

a lower roller positioned relative to the upper roller such that the upper and lower rollers form an envelope sealing nip, the lower roller having an outer diameter that varies along a longitudinal axis of the lower roller to form radial rings and radial grooves, a portion of the radial rings of the lower roller coinciding in an axial direction with respective grooves of the upper roller;

a lower shaft on which the lower roller is mounted; and means associated with the lower shaft for adjusting an orientation of the lower shaft to match an orientation of the upper shaft.

10. The device according to claim 9, wherein:

the upper roller has a maximum outer radius;

the lower roller has a maximum outer radius; and a sum of the two maximum radii exceeds a center-to-center distance between the upper and lower rollers.

11. The device according to claim 10, wherein the upper roller has a stop region adapted to interact with one of the radial rings of the lower roller to limit movement of the lower roller in an axial direction relative to the upper roller to prevent some of the radial rings of the lower roller from contacting some of the radial rings of the upper roller.

12. A device for processing envelopes, comprising:

a base;

feed means mounted on the base for feeding envelopes along a feed path, the feed means including:

an endless belt having a lower belt run that is adapted to contact and propel the envelopes along the feed path;

a plurality of pressure rollers biased to contact a lower surface of the lower belt run; and a plurality of backup rollers in contact with an upper surface of the lower belt run;

an upper sealer roller mounted on a common shaft with one of the backup rollers for rotation with the one of the backup rollers;

a lower sealer roller positioned relative to the upper sealer roller such that the upper and lower sealer rollers form an envelope sealing nip;

a lower shaft on which the lower sealer roller is mounted; and means associated with the lower shaft for adjusting an orientation of the lower shaft to match an orientation of the common shaft.

13. The device according to claim 12, wherein the means for adjusting includes a ski having a pair of ski arms for mounting the lower shaft.

14. The device according to claim 13, wherein each of the ski arms has a slot therein, each of the slots having a respective end of the lower shaft received therein.

15. A device for processing envelopes, comprising:

a base;

feed means mounted on the base for feeding envelopes along a feed path adjacent a registration wall, the feed means including:

an endless belt having a lower belt run that is adapted to contact and propel the envelopes along the feed path;

a plurality of pressure rollers biased to contact a lower surface of the lower belt run; and a plurality of backup rollers in contact with an upper surface of the lower belt run;

an upper sealer roller mounted on a common shaft with one of the backup rollers for rotation with the one of the backup rollers;

a support shaft extending substantially horizontally from the registration wall toward the feed means;

a ski pivotally mounted on the support shaft and having two arms extending upwardly substantially in parallel to each other, each of the arms having a respective slot formed therein, each of the slots having a generally vertical course;

an idler shaft having a first end received in one of the slots and a second end received in the other of the slots;

a lower sealer roller mounted on the idler shaft and in contact with the upper sealer roller;

a first torsion spring installed on the support shaft adjacent one of the arms and in contact with the first end of the idler shaft to bias the first end in an upward direction; and a second torsion spring installed on the support shaft adjacent the other of the arms and in contact with the second end of the idler shaft to bias the second end in an upward direction.

16. The device according to claim 15, wherein the courses of the slots are substantially straight.

17. The device according to claim 15, wherein the courses of the slots are curved.

18. The device according to claim 15, wherein:

the upper sealer roller has an outer diameter that varies along a longitudinal axis of the upper sealer roller to form radial rings and radial grooves; and the lower sealer roller has an outer diameter that varies along a longitudinal axis of the lower sealer roller to form radial rings and radial grooves;

a portion of the radial rings of the lower sealer roller coinciding in an axial direction with respective grooves of the upper sealer roller.

19. The device according to claim 18, wherein:

the upper sealer roller has a maximum outer radius;

the lower sealer roller has a maximum outer radius; and a sum of the two maximum radii exceeds a center-to-center distance between the upper and lower sealer rollers.

20. The device according to claim 19, wherein the upper sealer roller has a stop region adapted to interact with one of the radial rings of the lower sealer roller to limit movement of the lower sealer roller in an axial direction relative to the upper sealer roller to prevent some of the radial rings of the lower sealer roller from contacting some of the radial rings of the upper sealer roller.

* * * * *